US007601928B1

(12) United States Patent
Magness et al.

(10) Patent No.: US 7,601,928 B1
(45) Date of Patent: Oct. 13, 2009

(54) PEDESTRIAN PUSH BUTTON

(75) Inventors: Robert D. Magness, Edmond, OK (US); Kerry B. Milligan, Oklahoma City, OK (US); Stephen P. Parduhn, Edmond, OK (US); Kevin S. Shook, Luther, OK (US); Raymond M. Woods, Edmond, OK (US)

(73) Assignee: Pelco Products, Inc., Edmond, OK (US)

( * ) Notice: Subject to any disclaimer, the term of this patent is extended or adjusted under 35 U.S.C. 154(b) by 0 days.

(21) Appl. No.: 12/115,399

(22) Filed: May 5, 2008

Related U.S. Application Data

(60) Provisional application No. 60/916,343, filed on May 7, 2007.

(51) Int. Cl.
*H01H 13/70* (2006.01)

(52) U.S. Cl. ..... 200/345; 340/925; 200/341

(58) Field of Classification Search ..... 200/17 R, 200/293, 16 B, 520, 521, 341, 345; 340/407, 340/925, 944
See application file for complete search history.

(56) References Cited

U.S. PATENT DOCUMENTS 4,025,922 A * 5/1977 Trawick, III ..... 342/24
4,187,418 A 2/1980 Harris
4,293,841 A 10/1981 Potter
4,618,797 A 10/1986 Cline
4,659,046 A 4/1987 Parduhn
4,691,884 A 9/1987 Parduhn
5,103,223 A * 4/1992 Humphrey ..... 340/944
D328,243 S 7/1992 Parduhn
D335,279 S 5/1993 Parduhn
5,299,111 A 3/1994 Parduhn et al.
5,332,944 A 7/1994 Cline
5,477,942 A 12/1995 Shea et al.
5,528,007 A * 6/1996 Williams et al. ..... 200/16 B
D373,947 S 9/1996 Parduhn
5,587,567 A 12/1996 Winter et al.
D379,756 S 6/1997 Parduhn
5,636,729 A 6/1997 Wiciel
5,645,255 A 7/1997 Parduhn
5,712,459 A * 1/1998 Ziegler ..... 200/5 R
5,767,465 A 6/1998 Fulton et al.
5,920,050 A 7/1999 Tolman
6,064,141 A 5/2000 Wiciel
6,195,021 B1 2/2001 Keaveney
6,204,446 B1 3/2001 Parduhn
6,340,936 B1 1/2002 McGaffey et al.

(Continued)

*Primary Examiner*—Kyung Lee
(74) *Attorney, Agent, or Firm*—Mary M. Lee

(57) ABSTRACT

A pedestrian push button that discourages vandals and resists weather-related damage. The plunger is contained in a sleek, solid housing formed by a cup-shaped front cover that overlaps and substantially encloses a shallower, cup-shaped body, to protect the electrical components inside. The body is attachable from the inside to the traffic pole or other support surface, and the cover engages the body by means of a "twist-lock" connection that is hidden from view in the installed device. This reduces the appeal of the push button to vandals while at the same time making it easier for authorized personnel to open the housing for service and repair. The back of the body is contoured to conform to both flat and curved support surfaces, making the push button easy to mount securely regardless of the shape of the support surface.

19 Claims, 6 Drawing Sheets

U.S. PATENT DOCUMENTS 6,357,709 B1 3/2002 Parduhn
6,466,140 B1 10/2002 McGaffey et al.
6,903,283 B2 * 6/2005 Skarlupka et al. ..... 200/16 B
6,980,126 B2 12/2005 Fournier
6,982,630 B2 1/2006 Beckwith et al.
7,258,314 B1 8/2007 Parduhn et al.
7,523,912 B1 4/2009 Woods

* cited by examiner

PEDESTRIAN PUSH BUTTON

This application claims the benefit of provisional application Ser. No. 60/916,343, filed May 7, 2007, entitled "Pedestrian Push Button," the contents of which are incorporated herein by reference.

FIELD OF THE INVENTION

The present invention relates generally to pedestrian push buttons for traffic control devices.

BACKGROUND OF THE INVENTION

Push buttons are commonly used in high traffic areas to control traffic lights for pedestrians crossing the roadways. These buttons typically are placed about chest high on the pole supporting the light or other traffic device being controlled. Because of their position on the pole, the push button is a common target for vandals and mischievous youngsters. In addition, the button is continuously exposed to the elements, making the electrical components contained in the button housing susceptible to damage from rain and salt spray, especially in coastal areas and tropical climates. Thus, there is a need for a push button that is less inviting to vandals and this more resistant to the elements.

DETAILED DESCRIPTION OF THE PREFERRED EMBODIMENT

Figure 1:
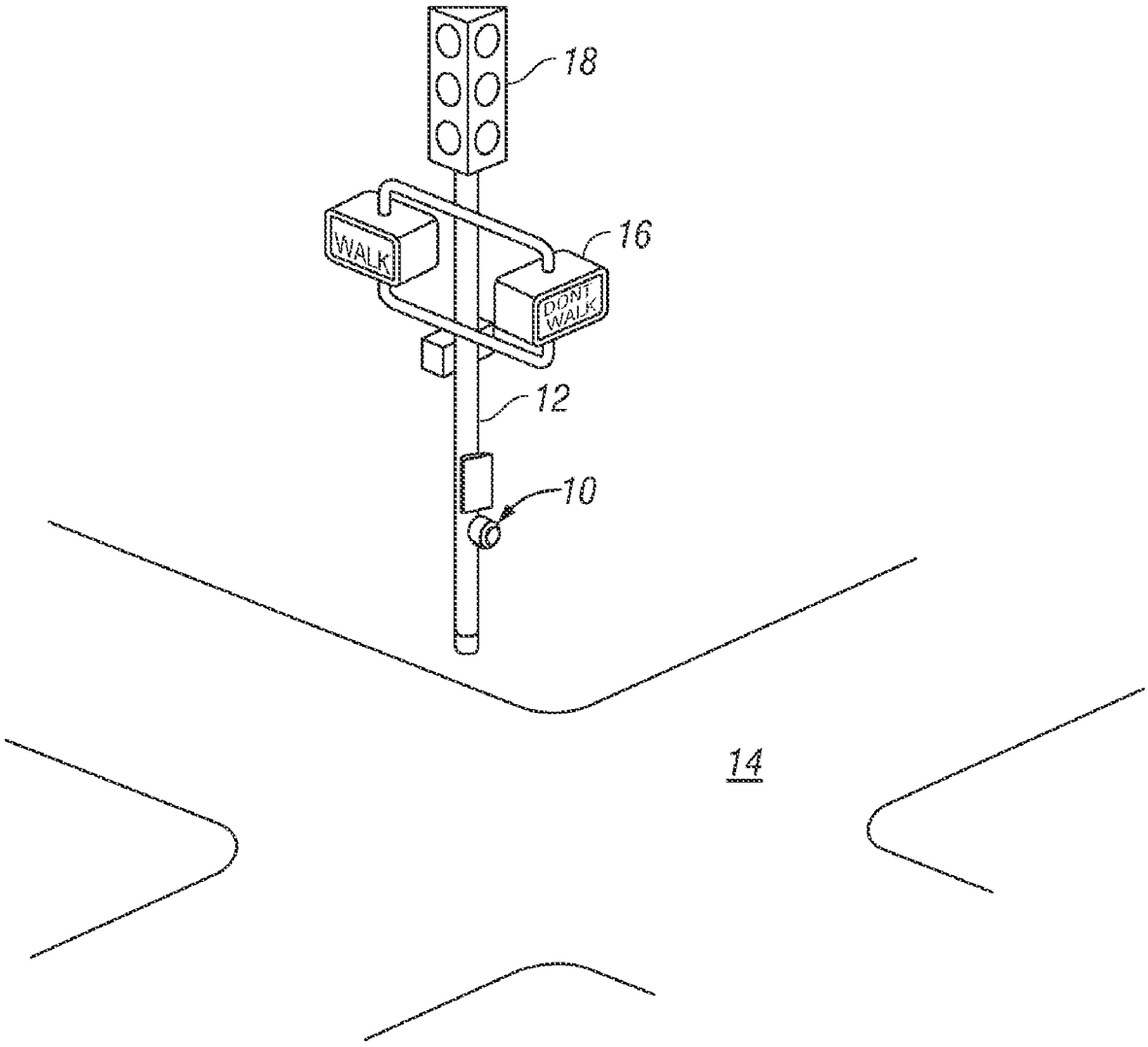
FIG. 1 is a perspective view of an intersection with a pedestrian crosswalk equipped with a traffic light and WALK and DON'T WALK lights that are controlled by a push button constructed in accordance with the present invention.

Turning now to the drawings in general and to FIG. 1 in particular, there is shown therein a pedestrian push button constructed in accordance with a preferred embodiment of the present invention and designated generally by the reference numeral 10. The push button 10 is shown installed on the side of a traffic pole 12 at a crosswalk 14.

In the embodiment shown, the push button 10 controls a WALK-DON'T WALK sign 16 supported on the pole 12 beneath a traffic signal light 18. However, the push button 10 of this invention may be used to activate or control any traffic control device. As used herein, "traffic control device" includes traffic signals, lights, signs and other devices for controlling the direction, flow and safety of vehicular (motorized and non-motorized) and pedestrian traffic.

Figure 2:
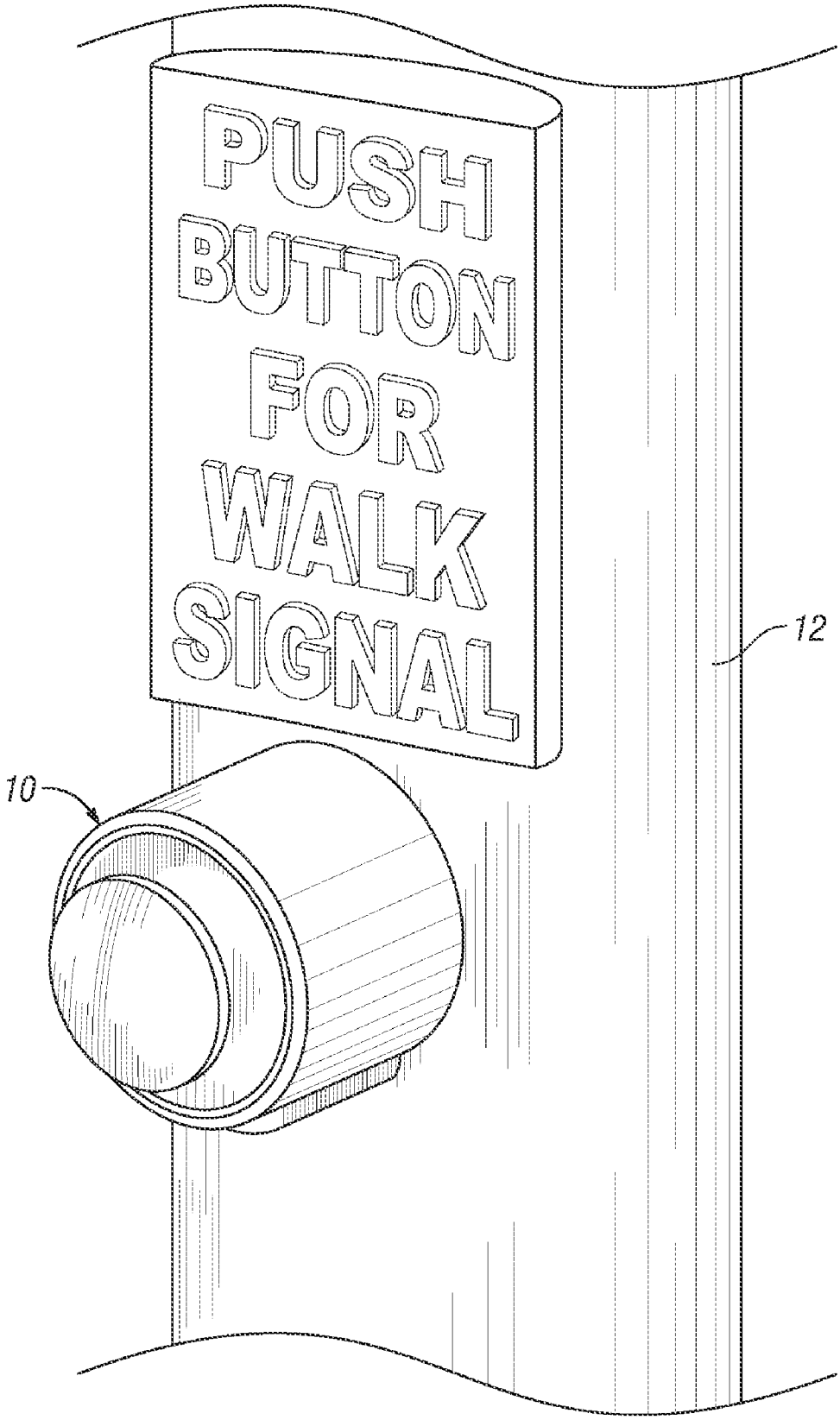
FIG. 2 is an enlarged, fragmented perspective view of the traffic pole showing the push button installed thereon.

As best shown in FIG. 2, in the illustrated embodiment, the support surface on which the push button 10 is mounted is the side of the traffic pole 12. However, the push button 10 may attached to a variety of other support surfaces, such as the flat side of a traffic control cabinet, a pedestal pole, the wall of nearby building or a retaining wall, or a wooden electrical poles.

Figure 3:
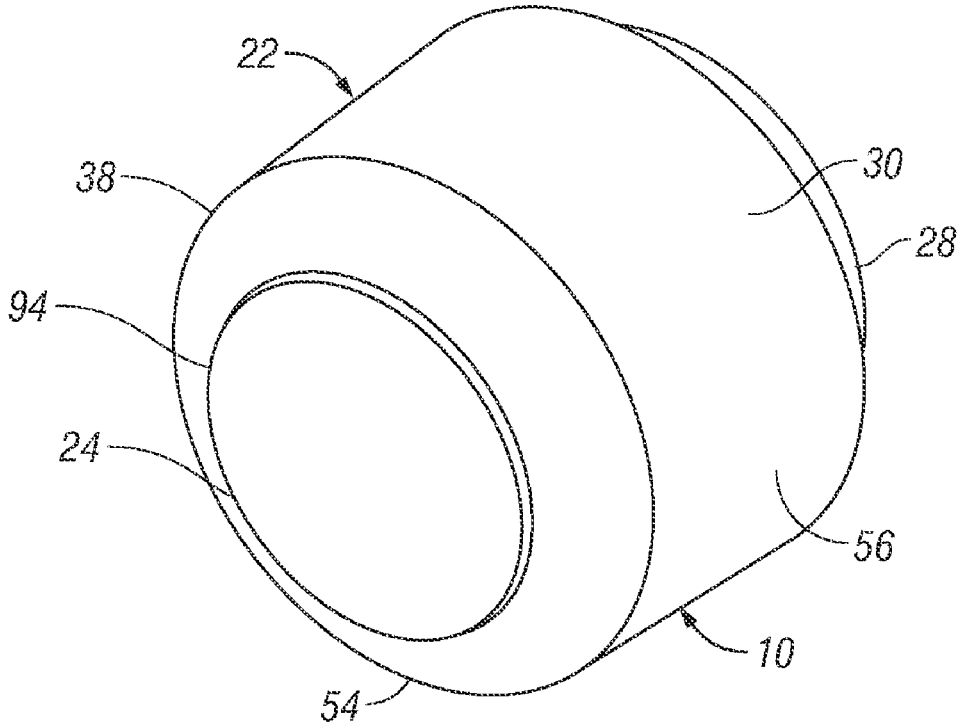
FIG. 3 is a frontal perspective view of the push button.
Figure 4:
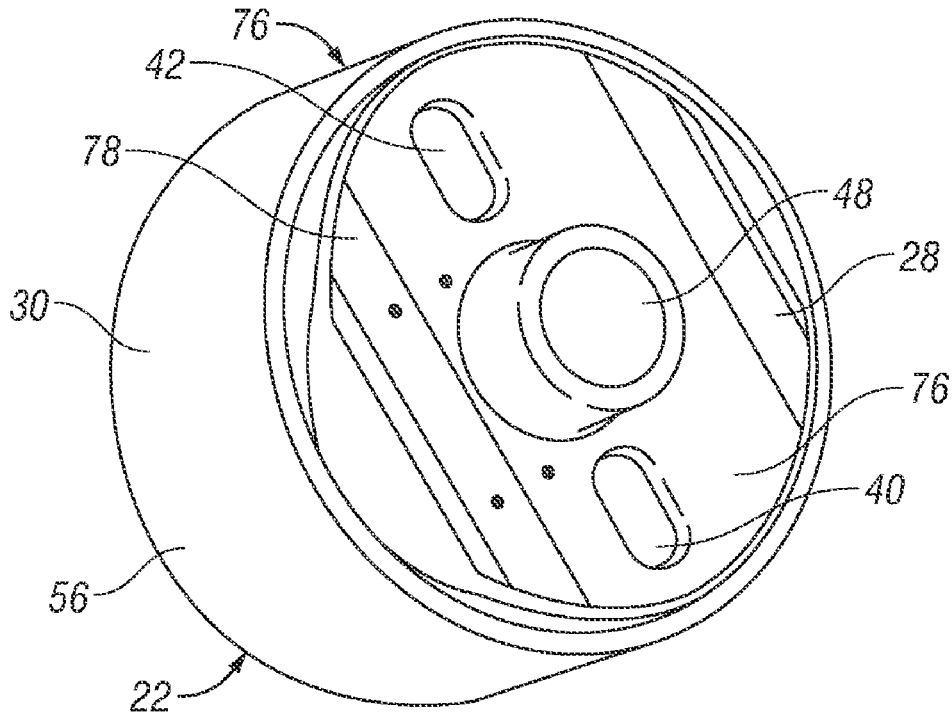
FIG. 4 is a rear perspective view of the push button.

With reference now to FIGS. 3 and 4, the push button 10 comprises a housing 22 for supporting the plunger 24 and internal components yet to be described. Preferably, the housing 22 comprises a body 28 and a cover 30.

Figure 5:
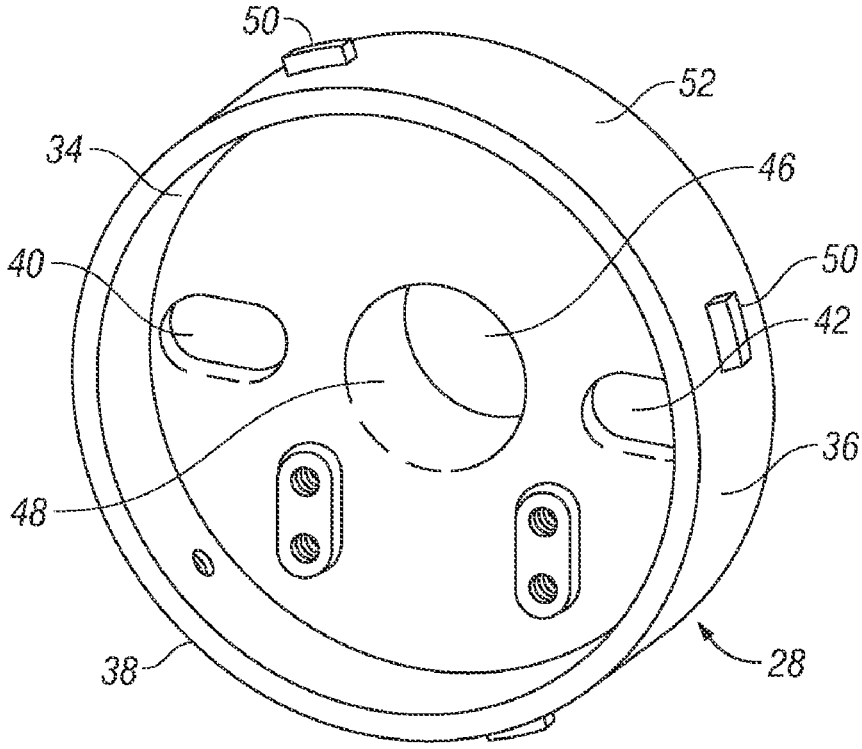
FIG. 5 is a frontal perspective view of the inside of the body of the housing.

Referring now also to FIG. 5, the body 28 comprises a rear panel 34 and a generally cylindrical side wall 36 extending forward of the rear panel and terminating in an open front end 38. The rear panel 34 is connectable to the traffic pole 12 (FIGS. 1 & 2) or other support surface from inside the side wall 36. For this purpose, the rear panel 34 may be provided with one or more holes for use with suitable connectors. For example, the rear panel 34 has two oval bolt holes 40 and 42, and the push button 10 may or not include a set of bolts (not shown) for connecting the body 28 to the pole 12. For mounting on surfaces which contain no wiring conduit, an adapter plate (not shown) may be interposed between the rear panel 34 and the mounting surface.

Referring still to FIGS. 4 and 5, the rear panel 34 preferably includes a wire opening 46 through the internal electrical components described below may be connected to the wiring in the pole 12. More preferably, the rear panel 34 comprises a tubular extension 48 extending outwardly or rearwardly from the back of the rear panel. This tubular extension 48 will serve as a cable or wire guide during installation of the push button 10.

As used herein, "forward" and "forwardly" and "frontal" refer to the end of the housing 22 supporting the plunger 24 and farthest from the traffic pole 12. "Rearward," "rearwardly," and "back" refer the opposite end of the housing 22 nearest the pole 12 or other support surface. "Inward" and "inwardly" refers to the inside of the housing 22, and "outward" and "outwardly" refer to the outside the housing.

For a reason that will become apparent, at least one and preferably a plurality of projections or lugs 50 are formed on the outer surface 52 of the side wall 36 of the body 28. In the embodiment shown three lugs, which are designated collectively by the reference numeral 50, are spaced around the side wall 36.

Figure 6:
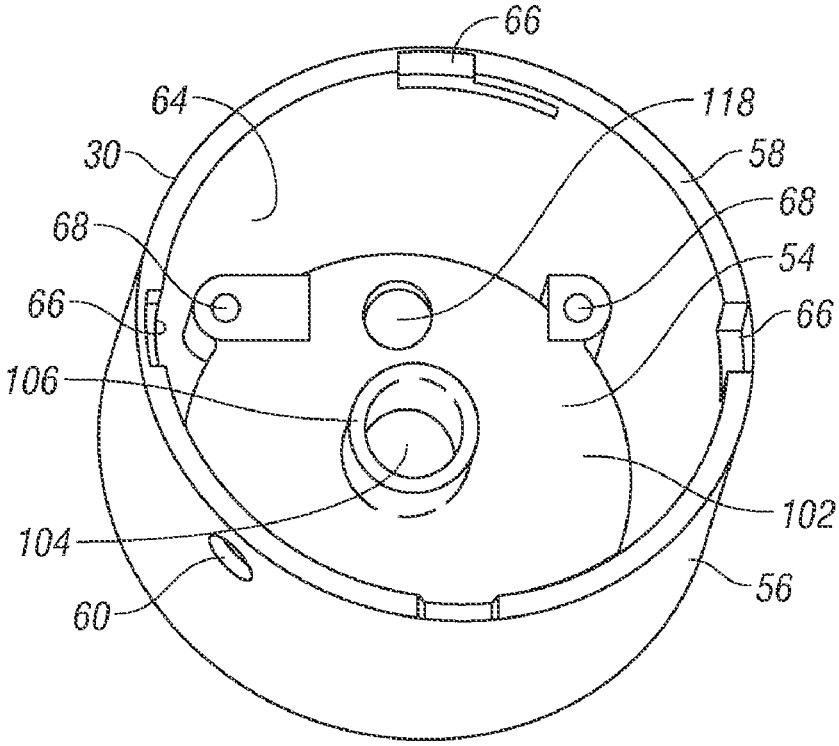
FIG. 6 is a rear perspective view of the inside of the cover of the housing.
Figure 7:
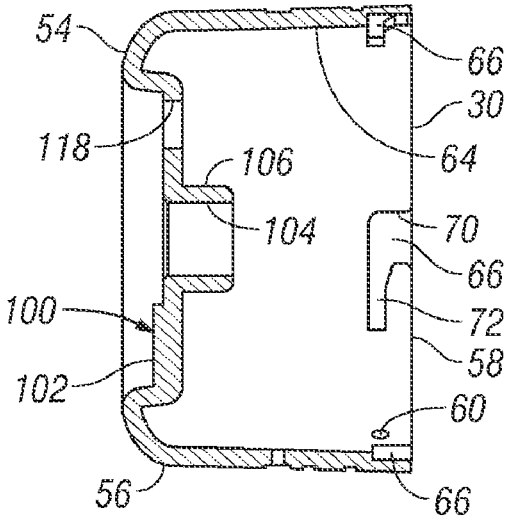
FIG. 7 is a longitudinal sectional view of the cover of the housing.

Referring still to FIGS. 3 and 4 and now also to FIGS. 6 and 7, the cover 30 will be further described. The cover 30 comprises a front face 54 and a side wall 56 that extends rearwardly from the front face and terminates in an open rear end 58. In its preferred form, the side wall 56 is generally cylindrical and substantially solid. As used herein, "substantially solid" denotes a smooth, seamless side wall uninterrupted by visible openings for connectors, such as screws or bolts, commonly used to attach pedestrian push button devices.

More preferably, the side wall 56 is integrally formed, as by machining or molding, from a solid piece of material. In the embodiment shown, the only interruption in the integrity of the side wall 56 is a small opening 60 for a set screw 62 (FIG. 4), which is positioned to be on the bottom of the housing 22 in the assembled device. Most preferably, the face 54 and the side wall 56 are together integrally formed and substantially solid (except to the opening for the plunger 24). Such a "connector-free" appearance reduces the likelihood that pranksters or vandals will attempt to disassemble the device.

The side wall 56 of the cover 30 is sized and shaped to receive the open front end 38 of the side wall 36 of the body 28 in a telescoping fashion. Provided on the inside surface 64 of the side wall 56 are lug-receiving recesses, such as the grooves 66. The number of grooves 66, which in this embodiment is three, preferably corresponds to the number of lugs 50 on the outer surface 52 of the side wall 36 of the body 28.

The grooves 66 are sized to snugly receive the lugs 50. More particularly, as best seen in FIG. 7, each of the grooves 66 includes an open portion 70 and a terminal portion 72. The open portion 70 is continuous with the open rear end 58 of the cover 30 and extends generally longitudinally, that is, in a directional generally parallel to the long axis of the cover 30. The terminal portion 72 is a closed-ended groove that extends a distance circumferentially from the open portion 70, thereby forming an L-shaped groove. Though the lug-receiving recesses could take the form of slots that extend entirely through the side wall 56 of the cover 30, the grooved form is preferred for reasons that will become apparent.

As best seen in FIG. 6, a pair of internally threaded screw bores 68 are formed on the inside of the front face 54 of the cover 30. These bores 68 serve as an attachment point for mounting the switch assembly yet to be described.

The open portions 70 are positioned around the open rear end 58 so that the lugs 50 can be aligned with them. Once the lugs 50 are aligned, the cover 30 can be advanced further over the body 28 until the lugs abut the end of the open portions 70. At this point, the cover 30 can be rotated about a quarter-turn on the body 28 so that the lugs 50 slide to the blind ends of the terminal portions 72. Thus, the side wall 36 of the body 28 and the side wall 56 of the cover 30 are cooperatively configured to form a twist lock engagement therebetween.

Moreover, since the grooves 66 do not extend through the side wall 56 of the cover 30, once the cover is connected to the body 28, both the grooves 66 and the lugs 50 are hidden in the assembled push button 10, as is best illustrated in FIG. 3. Though, the open portions 70 of the grooves 66 are visible from the back of the push button 10 (FIG. 4), these are not readily visible when the push button is attached to the pole 12 or other supporting surface, as seen in FIG. 2. For this reason, in most instances, it will be desirable to size the side wall 56 of the cover 30 so that, when the push button 10 is assembled, the side wall of the cover will substantially cover or overlap the side wall 36 of the body 28; this will place the open rear end 58 as near as possible to the pole 12 or other mounting surface.

In the embodiment shown and described herein, the lugs 50 are formed on the outer surface 52 of the side wall 36 of the body 28, and the grooves 66 are formed on the inside surface 64 of the side wall 56 of the cover 30. It will be appreciated that the placement of these elements could be reversed, that is, the lugs or projections 50 could be placed on the inside 64 of the cover 30 and the recesses 66 formed on the outer surface 52 of the body's side wall 36. The present invention contemplates either arrangement.

Also formed on the inside of the front face 54 of the cover 30 are internally threaded bores 68 for receiving screws that attach a mounting plate to be described later.

Returning to FIG. 4, yet another feature of the present invention is shown. The rear panel 34 of the body 28 may be shaped to conform to the shape of the intended support surface. Thus, where the intended support surface is the side of a traffic pole 12, which is curved (FIG. 2), the rear panel 34 preferably has a first section 76 that is curved. Alternately, the push button 10 may be mounted on a flat panel of some sort, in which case it is advantageous to provide the rear panel 34 with a flat surface, such as the second flat section 78.

Most preferably, the rear panel 34 is provided with both shapes, that is, with both a curved section 76 and a flat section 78 in a manner that permits the rear panel to conform alternately to either support surface, as in the preferred embodiment. To use the flat section 78, the body 28 would be positioned as shown in FIG. 4, with the holes 40 aligned horizontally. To use the curved section 76, the body 28 would be rotated about 90 degrees from the position shown in FIG. 4, so that the holes 40 are aligned vertically.

Figure 9:
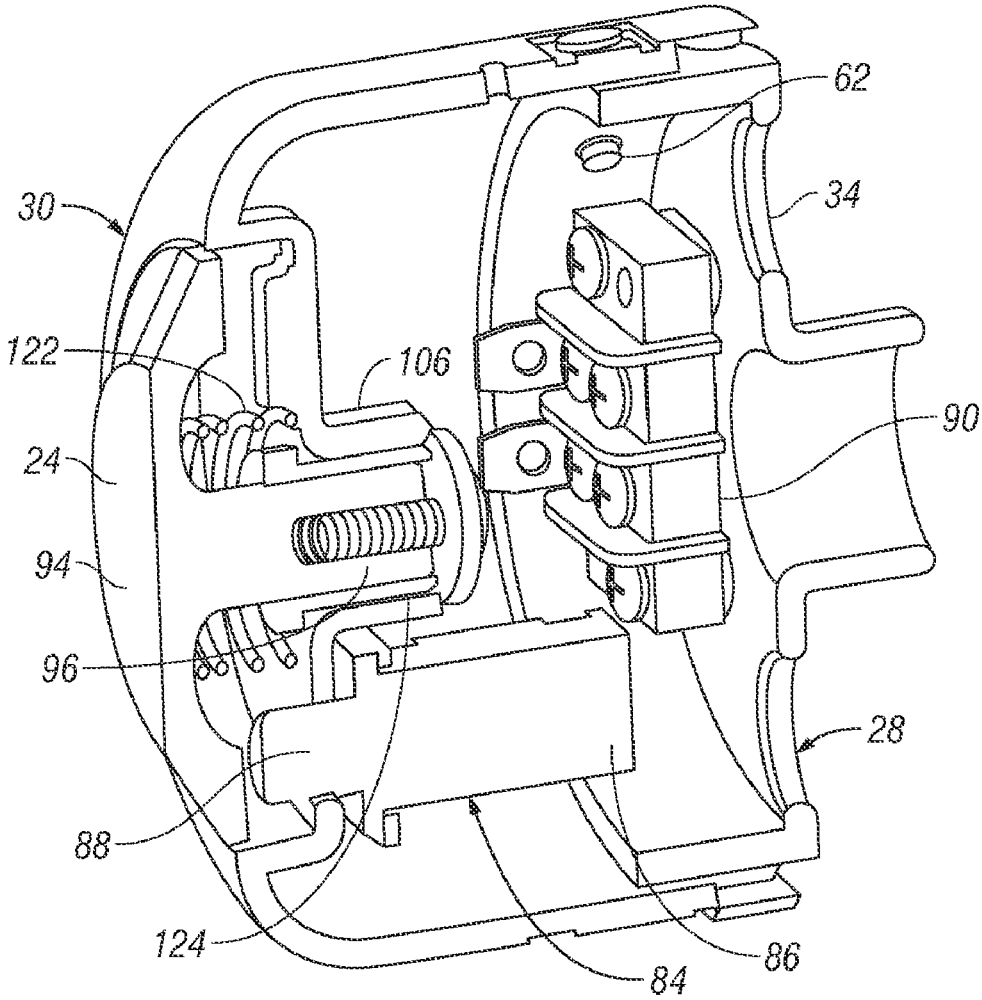
FIG. 9 is a longitudinal perspective, sectional view of the assembled push button.

With continuous reference to FIGS. 3, 6, and 7, and turning also to FIGS. 9 and 10, a preferred switch assembly 84 will be explained. The switch assembly 84 is operable between an ON position and an OFF position. The switch assembly 84 is operatively connectable to the WALK—DON'T WALK signs 16 or the signal 18, or both, or other traffic control devices, so that in the ON position the switch activates the traffic control devices, and so that in OFF position the switch does not activate the devices. In most instances, the switch assembly 84 will be biased in the OFF position. In this way, the traffic control devices will be affected only when a pedestrian is present at the crosswalk 14 to operate the push button 10 manually.

The type of switch mechanism may vary. For example, in some instances, a piezoelectric element may be employed. However, in a presently preferred embodiment, best seen in FIGS. 9 and 10, the preferred switch assembly 84 comprises a switch 86 usually including a movable member or button 88, which will close the circuit (not shown) when pressed. As shown, the switch housing 86 is mounted on the inside of the cover 30 so that operation of the plunger 24 will press the switch button 88, in a manner set for the hereinafter in more detail.

A terminal block 90 usually also is included for electrically connecting the pushbutton 10 to the supply wires, although wire nuts can be used instead. The terminal block 90 is conveniently attached by screws 92 or in any suitable manner to the rear panel 34 of the body 28 or in any appropriate location inside the body. During installation, the lead wires (not shown) from the switch housing 86 are connected to the terminal block 90, as described elsewhere.

Figure 8:
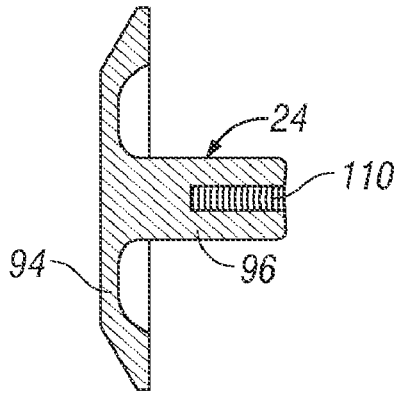
FIG. 8 is a longitudinal sectional view of the plunger.

The preferred configuration and mounting of the plunger 24, identified earlier, now will be described. The plunger 24 is mounted in the housing 22 for movement between a resting position and a pressed position. As seen in FIG. 8, the plunger 24 generally comprises a domed or disk-shaped head 94 and a switch-engaging member, such as the stem 96, extending rearwardly from the head.

The front face 54 of the cover 30 defines a plunger recess 100, which varies with the shape and type of push button 24 that is utilized. As best seen in FIGS. 8-10, the plunger recess 100 preferably comprises an annular shelf 102 surrounding a plunger opening 104 that is continuous with a tubular shaft 106 extending rearwardly of the face 54. The plunger recess 100 is shaped to receive the plunger 24. More specifically, the annular shelf 102 is sized to receive the disk-shaped head 94 of the plunger 24, and the tubular shaft 106 is sized to receive the stem 96. In this way, the plunger 24 is movably mounted in the face 54.

To prevent the plunger 24 from being pulled completely out of the housing 22, the stem 96 is provided with an internally threaded blind bore 110 to receive a bolt 112, which captures a washer 114 therebetween. The bolt and washer 112 and 114 engage the end of the shaft 106, preventing the stem 96 from pulling further out of the shaft.

To provide contact between the switch button 88 of the switch assembly 84 inside the housing 22 with the moving plunger 24, an opening 118 sized to receive the switch button is provided in the annular shelf 102 of the plunger recess 100. See FIGS. 6 and 7. Thus, as the head 94 of the plunger 24 moves in and out of the plunger recess 100, the switch button 88 will be moved from the off position to the on position.

As indicated, it is preferable for the plunger 24 to be biased in the resting position. To that end, a coil spring 122 may be interposed between the head 94 and the annular shelf 102 around the stem 96. The spring 122 is compressed when the head 94 of the plunger 24 is pressed, but returns to the extended position when pressure on the head is released.

The repetitive movements of the stem 96 inside the tubular shaft 106 may cause friction. This interface is also susceptible to encroachment by moisture and salt. To reduce the damage associated with these problems, the push button 10 preferably comprises a bushing 124 made of a suitable wear-resistant, friction-reducing material. In one preferred embodiment, the bushing 124 is formed of oil-impregnated bronze. This provides a low friction bearing surface between the stem 96 and the shaft 106 that is self-lubricating. Other suitable materials include Teflon coated metal, plastic, or other metals, such as stainless steel or aluminum.

Figure 10:
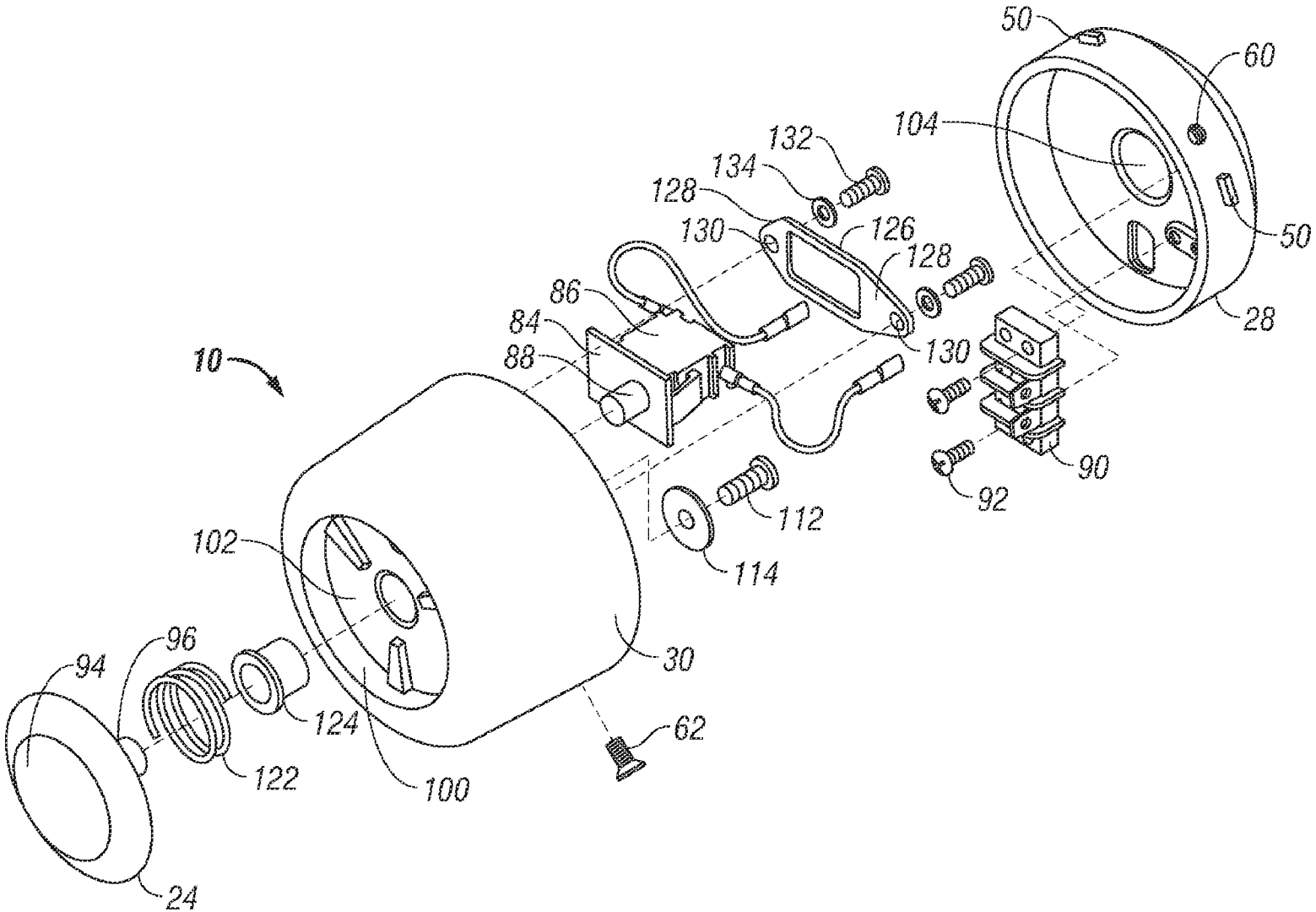
FIG. 10 is an exploded view of the push button.

Referring still to FIG. 10, the preferred mounting for the switch 84 is shown. A switch mounting plate 126 if formed to fit over the body of the switch 84. The plate 126 includes ears 128 with openings 130 to receive screws 132 with washers 134. The stems of the screws 132 are received in the bores 68 (FIG. 6) described previously.

In the preferred embodiment, the body 28, the cover 30, and the plunger 24 all are integrally formed of stainless steel. This provides a corrosion resistant finish and eliminates the need for painting.

Having described the preferred structure of the push button 10, its manner of use will be explained. First, the intended support structure, such as the traffic pole 12 is selected, and the shape—curved or flat—is determined. Next, a wire opening (not shown) in the pole 12 is made at the level at which the push button is to be mounted. Or, if the mounting surface has no wiring conduit, an external conduit may be used with an adapter plate (not shown).

The housing 22 is opened, that is, the body 28 is separated from the cover by opening the twist lock engagement. Wires from the pole 12 are connected to the wires (not shown) from the terminal block 90 extending out through the tubular extension 48 on the back of the rear panel 34 of the body 28 (or directly to the wires using wire nuts). Then, the body 28 is bolted to the pole 12, or attached to the pole in some other suitable manner.

Having attached the body 28 to the pole 12, the leads (not shown) from the switch housing 86 are connected to the terminal block 90. Then the cover 30 is connected to the body 28 using the twist lock. Finally, the set screw 62 is inserted into the set screw opening 60 on the bottom of the housing 22 to secure the cover 30. The push button now is operational.

Now it will be appreciated that the pedestrian push button of the present invention provides a seamless, solid housing without visible screw heads or other connectors. This makes a weather resistant enclosure which does not tempt would-be vandals.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present invention have been described in the drawings and accompanying text, the description is illustrative only. Changes may be made in the details, especially in matters of shape, size, and arrangement of the parts within the principles of the invention to the full extent indicated by the broad meaning of the terms of the attached claims. The description and drawings of the specific embodiments herein do not point out what an infringement of this patent would be, but rather provide an example of how to use and make the inventions. The limits of the inventions and the bounds of the patent protection are measured by and defined in the following claims.

What is claimed is:

1. A pedestrian push button for activating a traffic control device associated with a support surface, the push button comprising:

a housing comprising:

a cover comprising a front face and a substantially solid side wall terminating in an open rear end, wherein the front face defines a plunger recess; and a body comprising a rear panel and a side wall extending forward of the rear panel and terminating in an open front end and wherein the rear panel is connectable to the support surface inside the side wall of the body;

wherein the side wall of the body is shaped to be telescopically received inside the side wall of the cover, and wherein the side wall of the body and the side wall of the cover are cooperatively configured to form a twist lock engagement therebetween that is hidden in the assembled push button and a switch inside the housing operable between an on and an off position, wherein the switch is operatively connectable to the traffic control device so that in the on position the switch activates the traffic control device, and wherein the switch is biased in the off position; and a plunger mounted in the housing for movement between a resting position and a pressed position, wherein the plunger comprises a head accessible through the plunger recess in the face of the cover and a switch-engaging member extending rearwardly from the head into the housing, wherein the plunger is positioned and shaped so that in the pressed position the switch-engaging member moves the switch to the active position and so that in the resting position the head permits the switch to return to the off position, and wherein the plunger is biased in the resting position.

2. The pedestrian push button of claim 1 wherein the housing further comprises:

at least one groove formed on one of the inside of the side wall of the cover and the outside of the side wall of the body; and at least one lug formed on the other one of the inside of the side wall of the cover and the outside of the side wall of the body, the lug sized and positioned to be slidably received in the at least one groove.

3. The pedestrian push button of claim 2 wherein the at least one groove is generally L-shaped having an open section continuous with the open rear end of the side wall on which the groove is formed, and a terminal section extending a distance circumferentially from the open section.

4. The pedestrian push button of claim 3 wherein the at least one groove comprises a plurality of grooves and wherein the at least one lug comprises a lug for each of the at least one grooves.

5. The pedestrian push button of claim 2 wherein the at least one groove is formed on the inside of the side wall of the cover and the at least one lug is formed on the outside of the side wall of the body.

6. The pedestrian push button of claim 1 wherein the rear panel of the body has an outer surface that is shaped to conform to the shape of the support surface associated with the traffic control device.

7. The pedestrian push button of claim 6 wherein the outer surface is of the rear panel of the body is curved to conform to the side of a traffic pole.

8. The pedestrian push button of claim 6 wherein the outer surface is of the rear panel of the body is flat.

9. The pedestrian push button of claim 6 wherein the outer surface is of the rear panel of the body has a first portion that is flat and a second portion that is curved to conform to the side of a traffic pole.

10. The pedestrian push button of claim 1 wherein the rear panel of the body has at least one bolt hole for attaching the body to the support surface.

11. The pedestrian push button of claim 10 wherein the rear panel of the body has a plurality of bolt holes for attaching the body to the support surface.

12. The pedestrian push button of claim 1 wherein the rear panel of the body includes a wire opening.

13. The pedestrian push button of claim 12 wherein the wire opening comprises a tubular extension extending outwardly from the rear panel.

14. The pedestrian push button of claim 1 wherein the side wall of the cover is sized to substantially cover the side wall of the body in the assembled push button.

15. The pedestrian push button of claim 1 wherein the switch is mounted to the inside of the cover.

16. The pedestrian push button of claim 1 further comprising a terminal block mounted to the inside of the body.

17. The pedestrian push button of claim 16 further comprising a coil spring for biasing the plunger in the resting position.

18. The pedestrian push button of claim 1 wherein the switch-engaging member comprises a stem extending rearwardly from the head of the plunger, and wherein the plunger recess comprises a plunger opening continuous with a tubular shaft extending rearwardly of the face and sized to receive the stem of the plunger, wherein the plunger recess further comprises an annular shelf in the front face surrounding the plunger opening, and wherein the head of the plunger is generally disk-shaped and is sized to be received in the annular shelf.

19. The pedestrian push button of claim 18 further comprises a bushing disposed inside the shaft and around the stem of the plunger, the bushing formed of a wear-resistant, friction-reducing material.

* * * * *